United States Patent [19]

Young

[11] Patent Number: 4,509,347

[45] Date of Patent: Apr. 9, 1985

[54] DOOR LOCKING SYSTEM

[75] Inventor: Quentin H. Young, San Antonio, Tex.

[73] Assignee: Southern Steel Company, San Antonio, Tex.

[21] Appl. No.: 393,701

[22] Filed: Jun. 30, 1982

[51] Int. Cl.[3] ..... E05B 47/00; E05B 65/06; E05C 1/06; E05C 1/12

[52] U.S. Cl. ..... 70/129; 70/279; 70/280; 292/140; 292/144; 292/170

[58] Field of Search ..... 70/129, 134, 277, 279, 70/280; 292/140, 144, 170

[56] References Cited

U.S. PATENT DOCUMENTS

| | | | |
|---|---|---|---|
| 1,946,384 | 2/1934 | Baril | 292/163 |
| 3,828,592 | 8/1974 | Horgan | 70/134 |
| 3,893,723 | 7/1975 | Boule | 292/140 |
| 4,099,752 | 7/1978 | Geringer | 292/144 |
| 4,141,610 | 2/1979 | Ando | 292/144 |
| 4,180,287 | 12/1979 | Youngblood | 292/144 |

*Primary Examiner*—Robert L. Wolfe

*Attorney, Agent, or Firm*—Mason, Fenwick & Lawrence

[57] ABSTRACT

A modular lock unit has a lock solenoid and an unlock solenoid connected to opposite ends of a bolt cam slide for operating a horizontally reciprocal bolt. A centered circuit automatically locks the door when it is closed and automatically retracts the bolt in the event that any obstruction is provided in the strike in the door so as to preclude damage to the solenoid employed for extending the bolt. A time delay relay in the circuit terminates power to the lock solenoid after it has been actuated for 1.5 seconds so as to preclude solenoid damage if the bolt is blocked.

29 Claims, 16 Drawing Figures

44
84
47
43
20
82
48
46
50
78
24
74
52
76
67
40
28
63
102
71
70
90
69
100
92
72
68
98
34
36
32
34
66
54
94
80
30
104
86
37
20
45
41
88
106
42

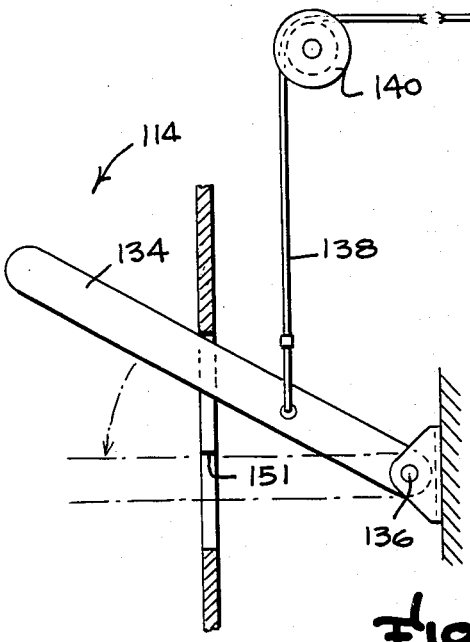
Fig-9
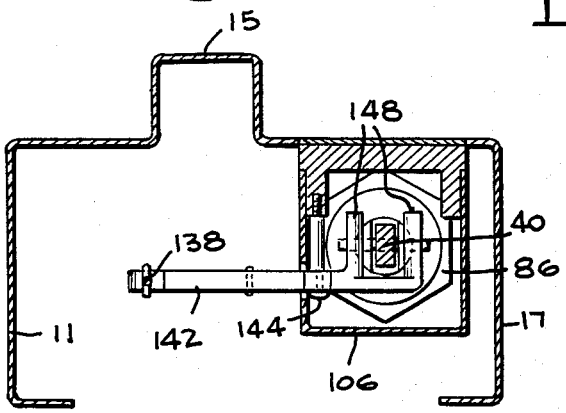
Fig-10
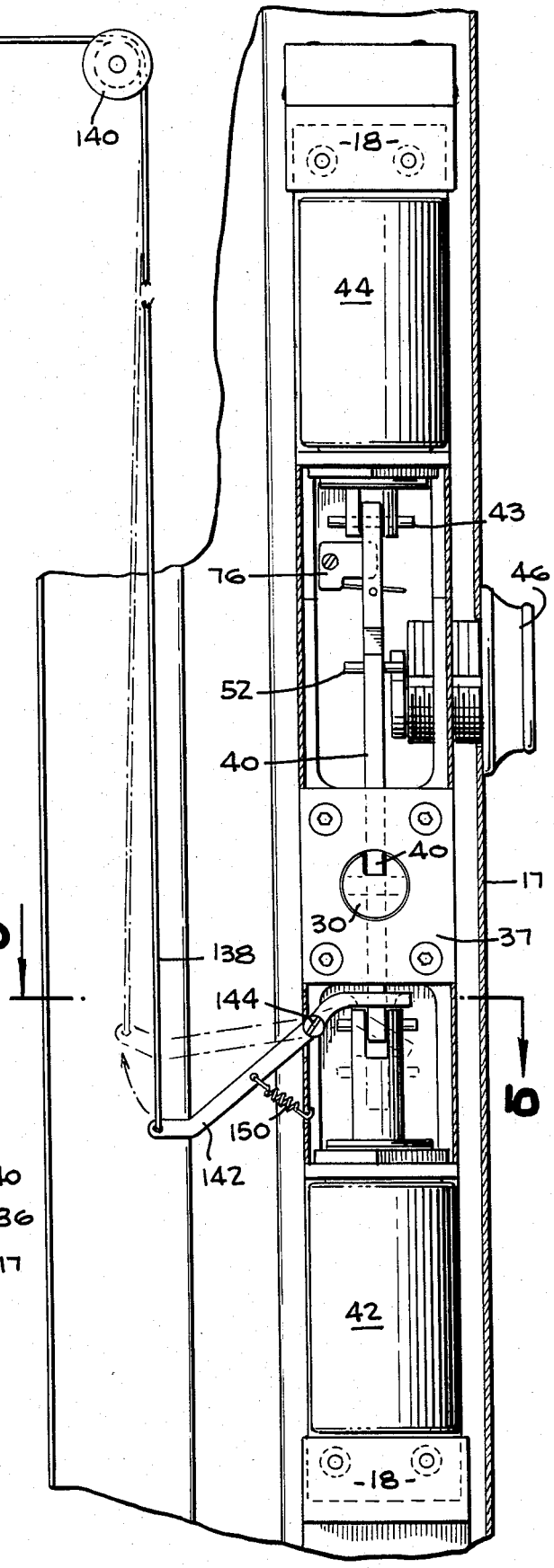

30
14
15
172
182
180
17
46
11
12
178
176
44
12

13
18
20
17
44
11
78
82
76
74
40
170
176
164
178
182
52
46
180
160
172
37
42
13

18
44
20
76
104
74
164
170
52
160
40
174
38
70
68
37
66
30
41
96
106
94
42

DOOR LOCKING SYSTEM

BACKGROUND OF THE INVENTION

The present invention is in the field of prison security equipment and is more specifically directed to a unique door locking system operable either from a remote location or at the door site.

Medium security penal institutions frequently house inmates in dormitory-like cells or rooms positioned along a common hall or corridor. It is desirable that the inmates be controlled with respect to leaving their room. It is also desirable in some instances to provide permissive locking of the room by the inmate upon his departure while retaining overall central control of the locking function of the door from a secure guard station. It is also desirable to permit the unlocking of the inmate's door by mechanical means from the guard station and at the door site in the event of electrical failure such as might well occur during a fire.

While previously known systems have attempted to provide one or more of the foregoing desirable features, they have failed to achieve widespread acceptance due to a number of shortcomings such as technical complexity, functional inadequacy, and high cost. For example, lightweight electric solenoid bolt control devices have been previously proposed such as in U.S. Pat. No. 3,893,723 which discloses a bolt positioned by a slide member 10 extending between upper and lower solenoids. While the device of this patent might well be satisfactory for low-security installations, it would be easily damaged by any substantial force applied against the bolt when the bolt is in its extended position due to the fact that such force would be immediately conveyed to the actuating solenoids so as to create a bending force on such solenoids to easily destroy the device. The well-known propensity for vandalism in penal institutions would therefore render the device of this patent totally unsatisfactory for penal institution use.

Other specially designed penal door locking systems are not usable with conventional steel door jambs and door assemblies so that the cost of the use of such devices is quite high.

Other prior-known devices such as that shown in U.S. Pat. No. 1,946,384 have employed solenoid actuated bolt members actuated by a pin and slot camming arrangement of complex construction suitable only for light duty in window sashes or the like.

Therefore, it is a primary object of the present invention to provide a new and improved door locking system for penal or similar institutions.

A further object of the present invention is the provision of a new and improved door locking system usable with a conventional steel door jamb.

Yet another object of the present invention is the provision of a new and improved door locking system that can be modularly installed in a conventional steel door jamb and which is operable for locking and unlocking both from a central control station and at the door site.

SUMMARY OF THE INVENTION

The foregoing and other objects of the invention are achieved by the provision of a modular unit consisting of a carrier frame including a heavy base plate and framework positionable in a steel door jamb and including a lock solenoid and an unlock solenoid connected to opposite ends of a bolt cam slide which passes through a vertical slot in a horizontally reciprocal bolt so that vertical movement of the slide effects movement of the bolt between an extended locking position and a retracted unlocking position. The slide includes a central slot oriented at approximately 45° and through which a lock pin extends. The upper and lower ends of the central slot extend in a vertical manner so that the lock pin enters the upper and lower ends to deadlock the bolt when in either its extended or retracted position. Camming movement of the bolt is effected by the front and rear edges of the slide whereas the lock pin serves the sole purpose of locking the bolt in either the unlock or lock position.

A control circuit for the solenoids includes means for permitting central control of the locking system from a guard station or the like and also includes means for giving the inmate the permissive ability to unlock his door under the control of the guard. The system further includes means for automatically locking the door when it is closed and for automatically retracting the bolt in the event that any obstruction is provided in the strike in the door so as to preclude damage to the solenoid employed for extending the bolt. Additionally, the circuit means includes a time delay relay system for terminating power to the locking solenoid after it has been actuated for 1.5 seconds so as to preclude solenoid damage. The slide for moving the bolt to its extended position is supported by heavy slide bearing surfaces in the support framework so that any force applied to the bolt is not conveyed to the solenoids but is absorbed by the framework and the slide member. Other features of the system include electrical key switches operable from either the inside or outside of the door jamb in which the system is mounted and a mechanical locking and unlocking cylinder arrangement is provided on the outside of the door jamb.

A better understanding of the manner in which the preferred embodiment achieves the foregoing and other objects will be enabled when the following detailed description is considered in conjunction with the appended drawings.

BRIEF DESCRIPTION OF THE DRAWING

FIG. 9 is a schematic elevational view of an alternative central control station actuated mechanical lock and unlock arrangement usable with the preferred embodiment;

FIG. 10 is a sectional view taken along lines 10—10 of FIG. 9;

DESCRIPTION OF THE PREFERRED EMBODIMENT

Figure 1:
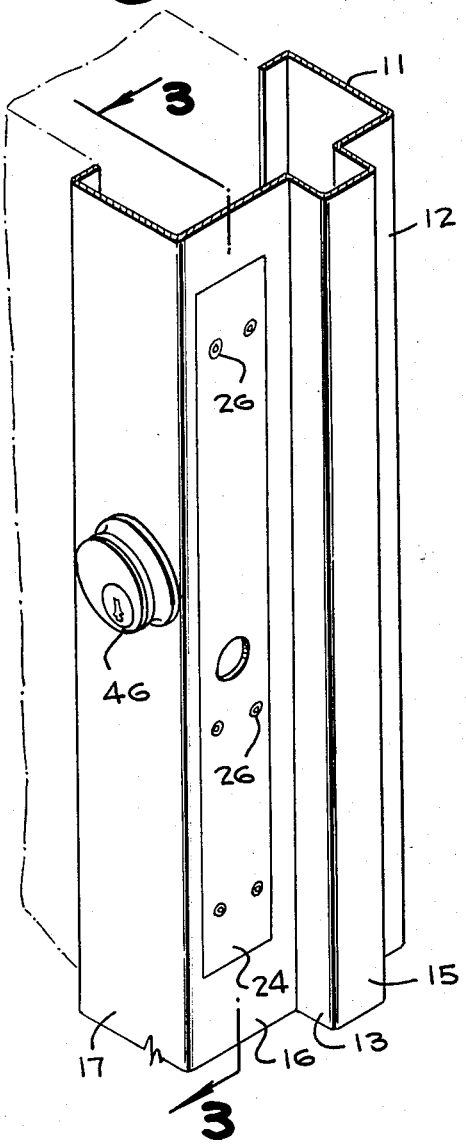
FIG. 1 is a perspective view of a steel door jamb portion in which the preferred embodiment of the invention is installed.
Figure 3:
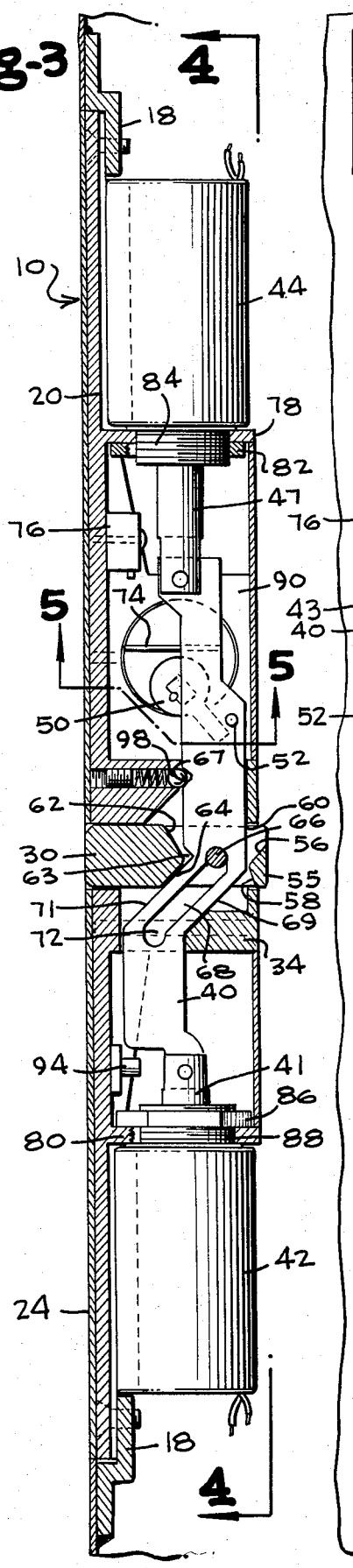
FIG. 3 is a sectional view taken along lines 3—3 of FIG. 1 illustrating the condition of the components when the bolt is in its retracted position.
Figure 4:
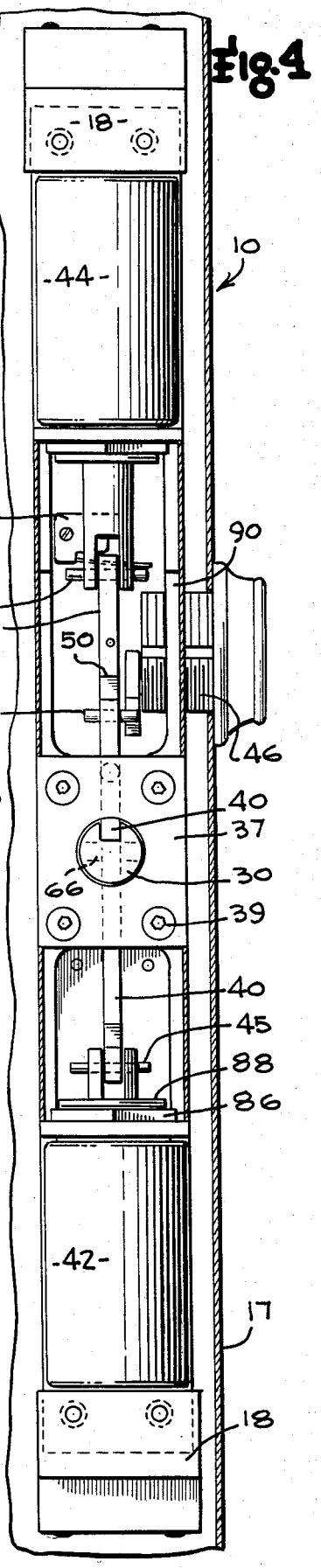
FIG. 4 is a sectional view taken along lines 4—4 of FIG. 3.

The preferred embodiment 10 of the invention is shown installed in a detention facility as is illustrated in FIG. 1. The preferred embodiment comprises a module which is mounted in a vertically extending steel door jamb 12 which is provided in facing relationship to a metal door 14 of an inmate's room mounted between the room and a corridor for swinging movement about a vertical axis in a well-known manner. Door jamb 12 includes a door edge facing rabbet 16 in which an aperture is provided for receiving the door locking mechanism of the invention which is mounted on upper and lower recessed flanges 18 as best shown in FIG. 3. Jamb 12 also includes a stop 13, a soffet 15, and exterior face 17 provided in a hall or corridor of a detention facility and an interior face 11 provided in the area to be secured such as an inmate's room.

Support for the operative components of the invention is provided by a relatively thick carrier frame which includes a base plate 20 from which various other support flanges and the like unitarily extend and which is mounted on the recessed flanges 18 of rabbet 16 by machine screws or the like 22. A cover plate 24 overlies the base plate 20 and is held in position by special security screws 26. A guide bolt aperture 28 is provided in the cover plate 24 and is of sufficient diameter to permit a cylindrical bolt 30 to move outwardly therethrough for effecting locking of the metal door 14 in a manner to be discussed.

Figure 2:
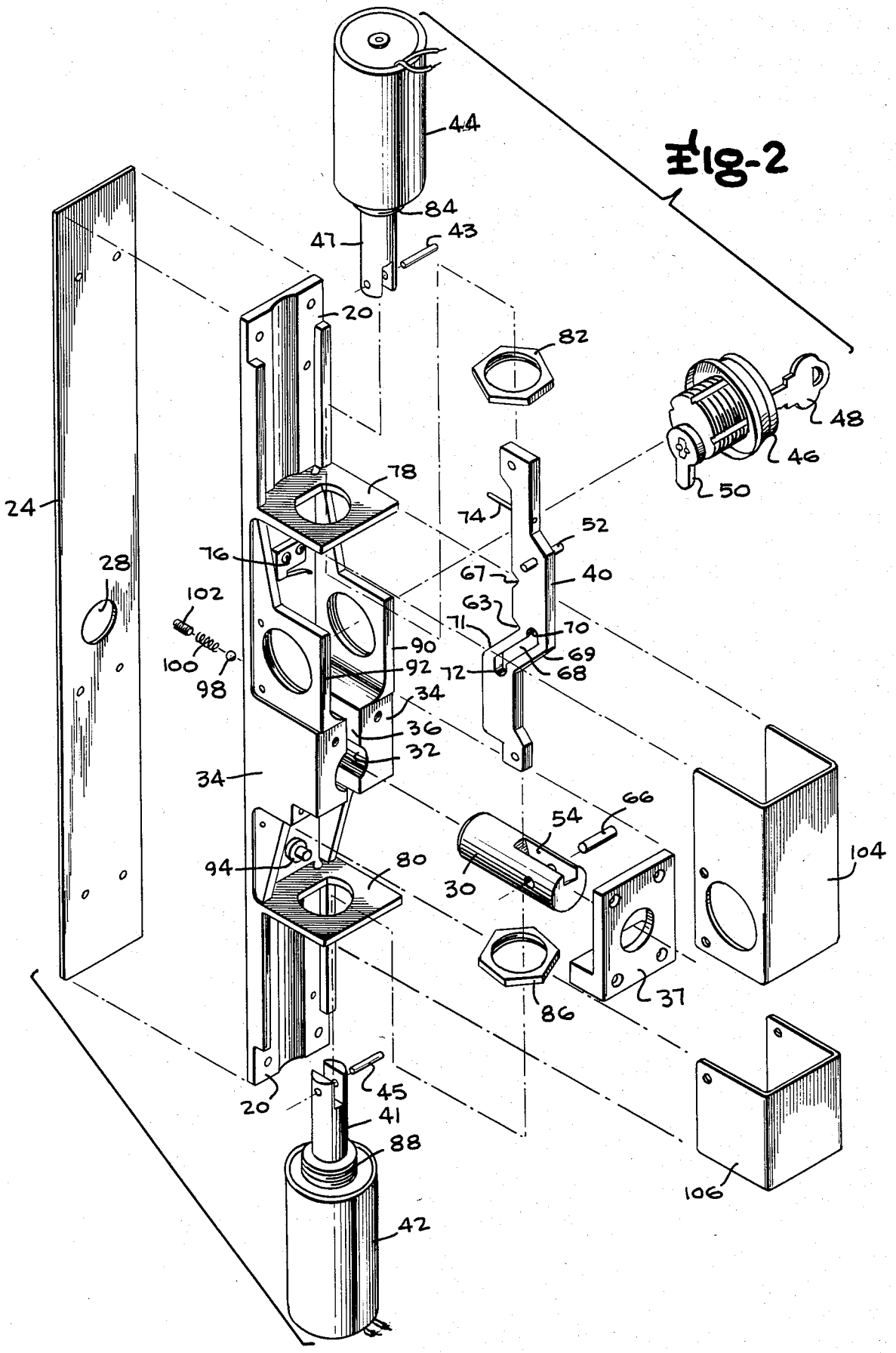
FIG. 2 is an exploded perspective view of the modular door jamb locking system of the preferred embodiment as viewed from the rear.
Figure 6:
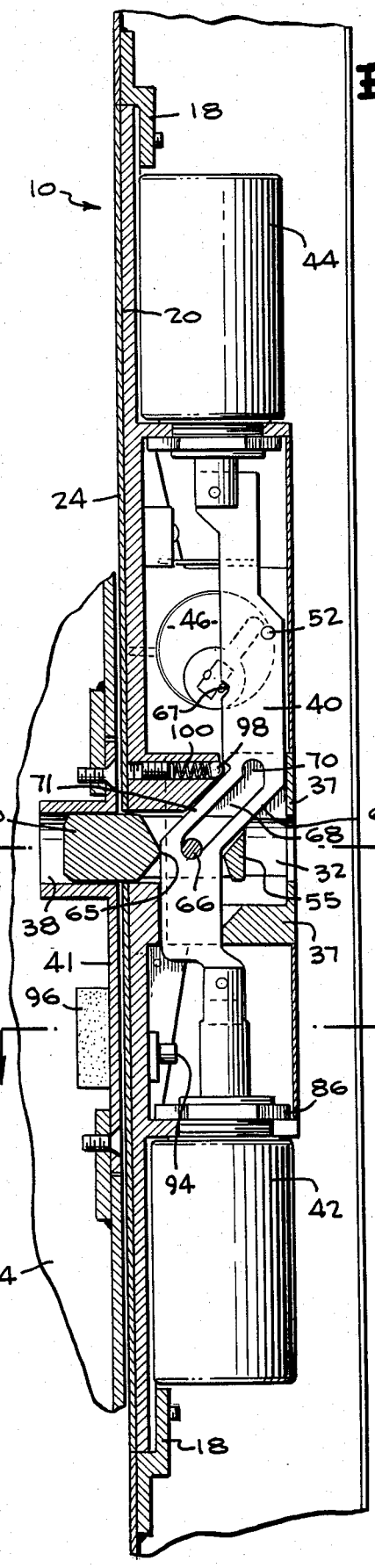
FIG. 6 is a sectional view similar to FIG. 3 but illustrating the bolt in its extended locking position in an adjacent door edge portion.
Figure 11:
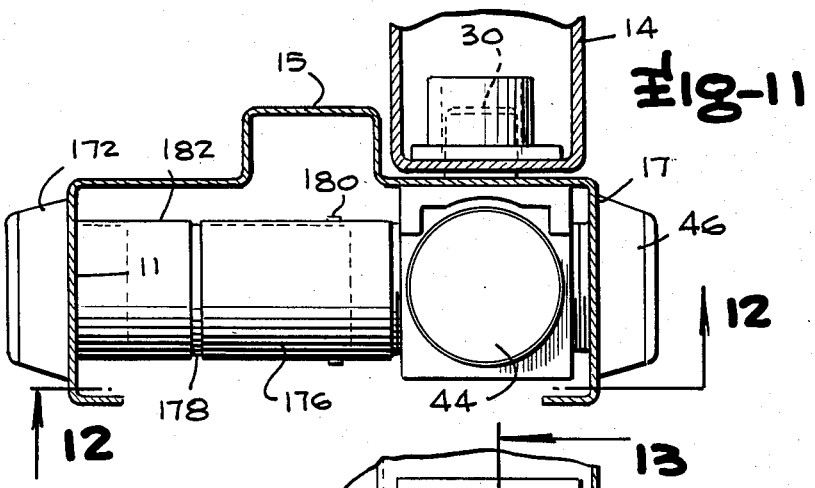
FIG. 11 is a plan view of an alternative embodiment illustrating the use of a lock operable from the interior of the inmate's room.

Bolt 30 is supported for reciprocation by cylindrical slide bearing surfaces 32 provided in bolt carrier blocks 34 which extend unitarily from the base plate 20 and which are separated by a vertically extending slide guide slot 36 as best shown in FIG. 2. A rigid cap plate 37 is fitted over the inner end surface of bolt carrier blocks 34 and is held in position by machine screws 39. Bolt 30 is supported for axial horizontal reciprocation between a first or unlock position which is illustrated in FIG. 3 in which the bolt is completely enclosed in the housing and a second or locking position in which the outer end of the bolt extends forwardly beyond the housing and cover plate 24 as shown in FIG. 6 so as to effectively enter a bolt receiving recess 38 provided in a strike 41 in the edge of door 14 as shown in FIG. 6.

Figure 5:
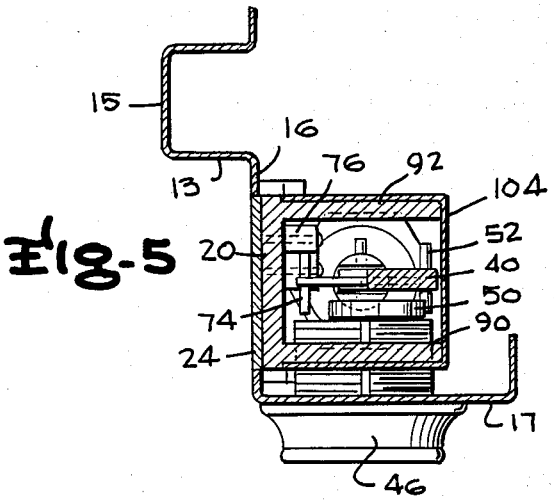
FIG. 5 is a sectional view taken along lines 5—5 of FIG. 3.
Figure 7:
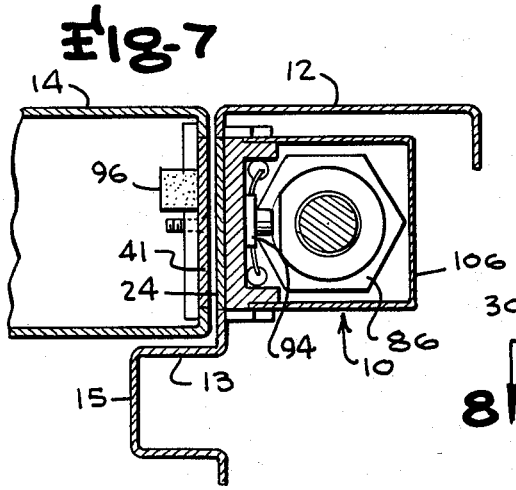
FIG. 7 is a sectional view taken along lines 7—7 of FIG. 6.
Figure 8:
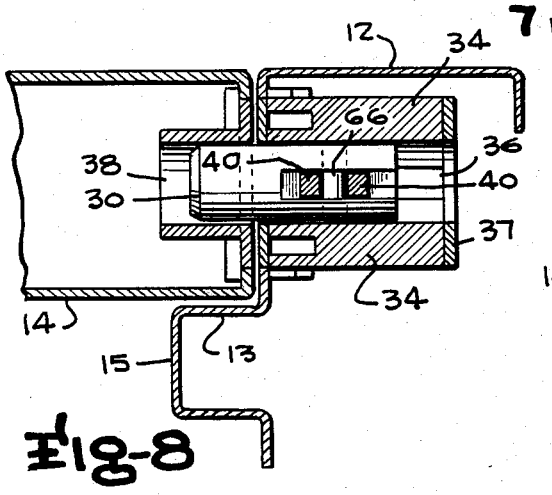
FIG. 8 is a sectional view taken along lines 8—8 of FIG. 6.

The means for moving the bolt 30 between its extended lock and its retracted unlock positions comprises a vertically extending bolt cam slide 40 positioned in the slide guide slot 36 and mounted for vertical reciprocation under the action of the plunger 41 of unlock solenoid 42 connected to the lower end of the bolt cam slide by a pin 43 and the plunger 47 of lock solenoid 44 connected to the upper end thereof by a pin 45. Actuation of the unlock solenoid 42 serves to effect movement of the bolt 30 to the unlock position of FIG. 3 whereas actuation of the lock solenoid 44 serves to effect movement of the bolt 30 to its locking position illustrated in FIG. 6. FIGS. 5 and 6 illustrate the fact that cam slide 40 is restrained against horizontal movement by portions of the carrier frame and cap plate 37.

Reciprocation of the bolt cam slide 40 can also be effected mechanically in a manual manner by means of a lock cylinder 46 operable by a key 48 and positioned on the outside face 17 (such as in a hall or corridor) of the steel door jamb 12. A cam arm 50 is positioned on the inner end of lock cylinder 46 and is rotated by the turning of the key 48 in a well-known conventional manner. Cam arm 50 is engageable with a drive pin 52 provided on the bolt cam slide member 40 so as to permit the occupant, guard, or any person having a proper key to unlock the door from the hall or corridor side thereof to gain entry to the room.

It will be observed that the bolt 30 is provided with a vertical slot 54 through which the bolt cam slide 40 extends. This slot is defined by a rear cross member 55 (FIG. 3) having an upper internal bolt retract follower surface 56 angled at approximately 45° with respect to the axis of bolt 30 and a lower surface 58. Bolt retract follower surface 56 faces and is parallel to a bolt retract camming surface 69 oriented at 45° relative to the direction of movement of bolt cam slide 40. The lower surface 58 faces the vertical rear edge surface 60 of the bolt cam slide when the bolt in its retracted position illustrated in FIG. 3. Similarly, the forward edge of the slot 54 in bolt 30 is defined by an upper surface 62 and a lower canted bolt extend follower surface 64 which is parallel to and faces a bolt extend 45° camming surface 71 on the front edge of bolt cam slide 40. Surface 71 is parallel to surface 69. It will be noted that the intersection of the surfaces 62 and 64 forms an apex 65 in facing relationship to a lower detent notch 63 in the forward edge of bolt cam slide 40 when the bolt cam slide 40 is in its unlocked position illustrated in FIG. 3. An upper detent notch 67 is also provided in the forward edge of the bolt cam slide 40.

A lock pin 66 is mounted in bolt 30 and extends across slot 54 and is positioned internally of a slot 68 provided in the bolt cam slide 40. Slot 68 is slightly larger than pin 66 and includes a central portion oriented at approximately 45° with respect to the axis of bolt 30 and upper and lower parallel vertical deadlock portions 70 and 72 respectively defining the upper and lower extent of the slot. The deadlock portions 70 and 72 serve to deadlock the bolt 30 in its unlock and lock positions respectively. A switch actuator pin 74 extends forwardly of the bolt cam slide 40 for engaging a lock bolt extended switch 76 when the bolt 30 is in its extended locking position for a purpose to be discussed hereinafter.

Support for lock solenoid 44 is provided by an upper solenoid support flange 78 while support for the unlock solenoid 42 is provided by a lower solenoid support flange 80. It should be observed that the lock solenoid 44 is held in position on the upper solenoid support flange 78 by a threaded nut 82 threadably engaged with a threaded tubular protrusion 84 of the solenoid casing as best shown in FIG. 3. A similar threaded nut 86 is engageable with a threaded protrusion 88 of the unlock solenoid 42 for retaining the unlock solenoid 42 on the lower solenoid support flange 80 in like manner. It should also be observed that the lock cylinder 46 is supported on a cylinder support flange 90 and an identical cylinder support flange 92 is provided on the opposite side of the carrier frame for permitting the optional installation of a lock cylinder on the interior of the inmate's room as is discussed in detail hereinafter.

A magnetically actuated mercury switch 94 is mounted on the base plate 20 in horizontal alignment with a permanent magnet 96 provided on the interior of the door as shown in FIG. 6. When the door is in the closed position of FIG. 6, magnet 96 effects the closing of contacts provided within the magnetically actuated mercury switch 94 for a purpose to be discussed hereinafter. Also, a conventional door position switch 110 having a movable switch element 112 alternatively engageable with the contacts 114 and 116 when the door is respectively positioned in its closed and open positions is provided. It should be understood that the door position switch 110 is of conventional construction and can be either mechanically or magnetically actuated by the position of the door. Normally, the door position switch 110 would be mounted in the door jamb or housing or possibly in one of the door hinges.

Additionally, a spherical detent ball 98 is provided in a bore extending through base plate 20 and is urged by a spring 100 toward the bolt cam slide 40 to engage the upper detent notch 67 when the bolt cam slide 40 is in its lower position of FIG. 3 and to similarly engage the lower detent notch 63 when the bolt cam slide 40 is in its upper position as shown in FIG. 6. It should be observed that the spring 100 is held in position by a threaded plug 102. Upper and lower cover members 104 and 106 are attached over the frame components to complete the assembly.

Figure 14:
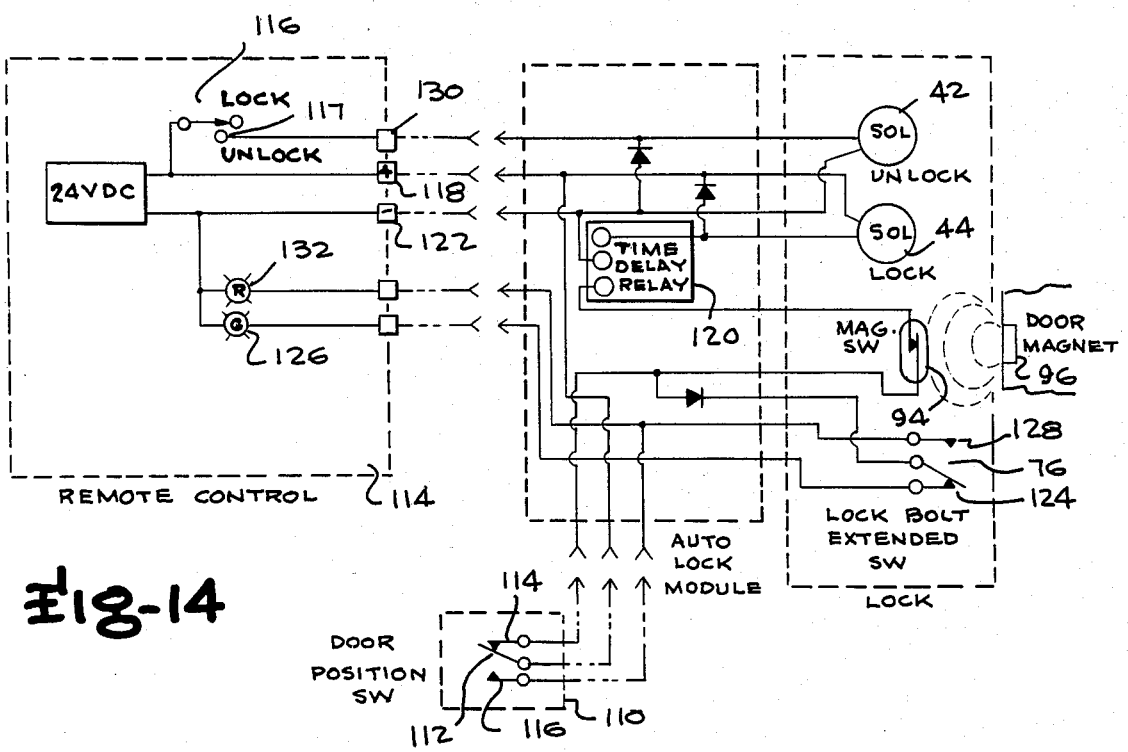
FIG. 14 is a circuit diagram of the basic control system.

The basic control circuitry for the lock assembly is illustrated in FIG. 14 and includes circuit elements which require that for the system to be actuated to effect movement of the bolt 30 to its extended lock position, the door position switch 110 and the magnetically actuated mercury switch 94 must both indicate that the door is in its closed position. It is consequently impossible for the bolt to be extended by solenoid 44 when the door is open; this fact prevents deliberate damage to the bolt by the inmates.

Further, the control system includes a remote control station 114 which can be operated by a guard for locking or unlocking the door from a secure remote position. The remote control station includes a main control switch 116 movable to either a lock or unlock position as shown for alternatively actuating the lock solenoid 44 or the unlock solenoid 42. When switch 116 is moved to the lock position illustrated in FIG. 14, power from a positive terminal 118 flows through the lock solenoid 44 which is actuated to move the bolt cam slide 40 upwardly to the position illustrated in FIG. 6. Such movement initially results in movement of pin 66 from the upper deadlock portion 70 of the slot in the bolt cam slide 40 into the canted portions 68 of the slot following which movement the bolt extend camming surface 71 of the slide engages the bolt extend follower surface 64 to move the bolt to its extended locking position. As surface 71 clears surface 64 near the upper end of the vertical stroke of slide 40, pin 66 enters the lower deadlock portion 72 of the slot to deadlock the bolt in its lock position. A solid state time delay control relay 120 (which is a conventional Model CS 344-1 timed delay relay sold by Quadtronics, 901 Lodi Street, Syracuse, N.Y.) is provided in the circuit extending from the lock solenoid 44 to a negative power terminal 122 and prevents solenoid 44 from burning out by terminating power thereto after a predetermined time period of approximately 1.5 seconds well in excess of the time required for the solenoid to lock the bolt.

Completion of the circuit to solenoid 44 cannot be completed unless the magnetic switch 94 is in its closed position as a result of the permanent magnet 96 in the door being positioned adjacent the switch 94. In fact, closure of the door automatically results in actuation of the lock solenoid by virtue of switches 94 and 110 being consequently positioned as shown in FIG. 14. Switch 110 must also be in the closed position illustrated in FIG. 14 in that switch 110 is in series with switch 94. Thus, it is necessary for both switches 94 and 110 to indicate that the door is in a closed position before the time delay control relay will permit the solenoid 44 to be actuated to extend the bolt to its locked position of FIG. 6. Moreover, the time delay control relay 120 also serves to automatically deactivate the lock solenoid 44 after a 1.5 second time delay sufficient to insure that the solenoid has moved the bolt to its extended locking position. Deactivation of the solenoid consequently precludes burning out of the solenoid coil as would occur if the solenoid was connected to power for an extended time period. Additionally, movement of the bolt 30 to its extended locking position also serves to position the switching element of the lock bolt extended switch 76 in contact with contact member 124 to complete a circuit through a green indicator light 126 indicating that the door is locked. The bolt cam slide 40 is held in the elevated locking position by the detent ball 98 which is positioned in the lower detent notch 63.

A further feature of the invention resides in the fact that the circuit will be automatically actuated to unlock in the event that the bolt 30 does not move to its fully extended position. This feature is of substantial significance in that inmates of correctional institutions are frequently prone toward malicious vandalism and might well fill the bolt receiving recess 38 with paper or a similar obstruction to preclude full insertion of the bolt in the expectation that damage or burning out to the solenoid would be resultant from such action. However, the present circuitry provides for an immediate deactivation of the lock solenoid 44 following termination of power after the 1.5 second time delay if the lock bolt extended switch 76 does not indicate that the lock bolt is fully extended. The circuitry for providing this result is inherent in the time delay control relay 120 and its circuit connections illustrated in FIG. 14.

If it is desired to unlock the door from the remote control station, switch 116 is actuated to contact the unlock terminal 117 to direct direct current from terminal 130 to the unlock solenoid 42 which is immediately actuated to cause the bolt cam slide 40 to start to move toward its lower position. The initial downward movement of the bolt cam slide 40 causes the pin 66 to clear the lower deadlock portion 72 of the slot in the cam slide 40 immediately following which the bolt retract camming surface 69 engages the bolt retract follower surface 56 to cause the bolt to be retracted to its fully retracted position illustrated in FIG. 3. The terminal portion of the downward stroke of the bolt cam slide 40 results in movement of pin 66 into the upper deadlock slot portion 70 so as to deadlock the bolt 30 in its retracted position to prevent anyone from pulling the bolt outwardly of the housing. Slide 40 is incapable of front to rear movement by virtue of its being in close contact with the supporting framework of the unit. Power to the unlock solenoid 42 is terminated after switch 116 is allowed to return to its locked position. Additionally, movement of the bolt 30 to the retracted position shifts the movable switch element of switch 76 from contact 124 to contact 128 so as to illuminate red indicator light 132 to advise the guard that the door is unlocked.

The bolt can also be actuated manually from the corridor side of the door by actuation of cylinder lock 46 by the use of key 48 so as to cause the cam arm 50 to rotate and engage the drive pin 52 to lift the bolt cam slide 40 to its upper lock position. The bolt cam slide 40 is held in the upper position by virtue of engagement of spherical detent ball 98 with the lower notch 63 provided in the forward surface of the bolt cam slide member 40.

Additionally, FIGS. 9 and 10 illustrate a modification of the preferred embodiment to permit a mechanical unlocking of the bolt from the control station in the event of electrical failure by the use of a lever 134 pivotally mounted at 136 in the control station and connected by a cable 138 extending over pulleys 140 to a drive lever 142 mounted for pivotal movement on pivot 144 in the lock housing. Upon movement of the levers 134 and 142 to their dashed-line positions, the lever 142 serves to push the plunger of solenoid 42 downwardly by engagement of its end portions 148 with the upper end of the plunger of solenoid 42. A spring 150 tends to return the lever 142 to its solid line position. Therefore, lever 134 would normally be latched under surface 151 in its lower position to overcome the force of spring 150.

Figure 13:
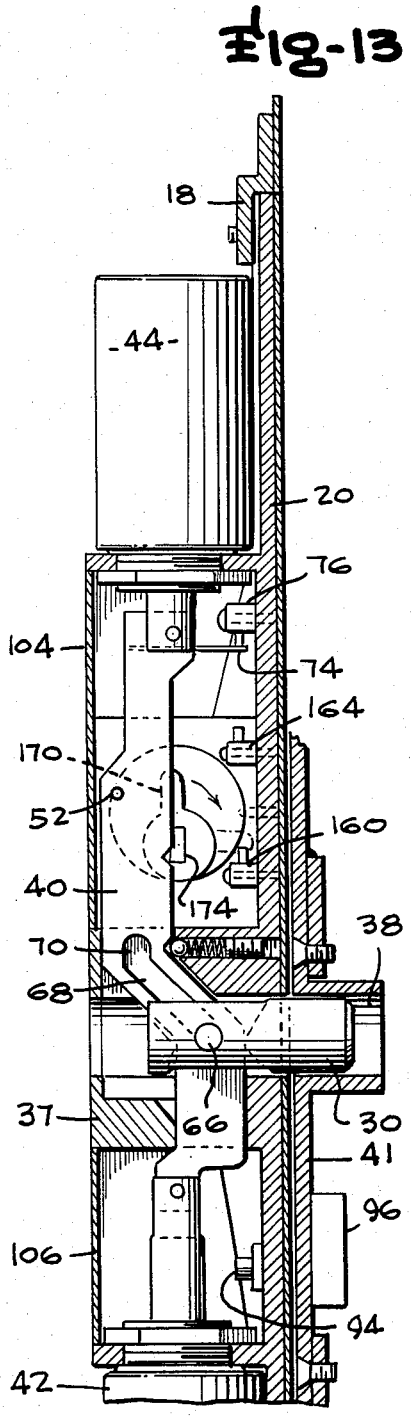
FIG. 13 is a sectional view taken along lines 13—13 of FIG. 12.
Figure 15:
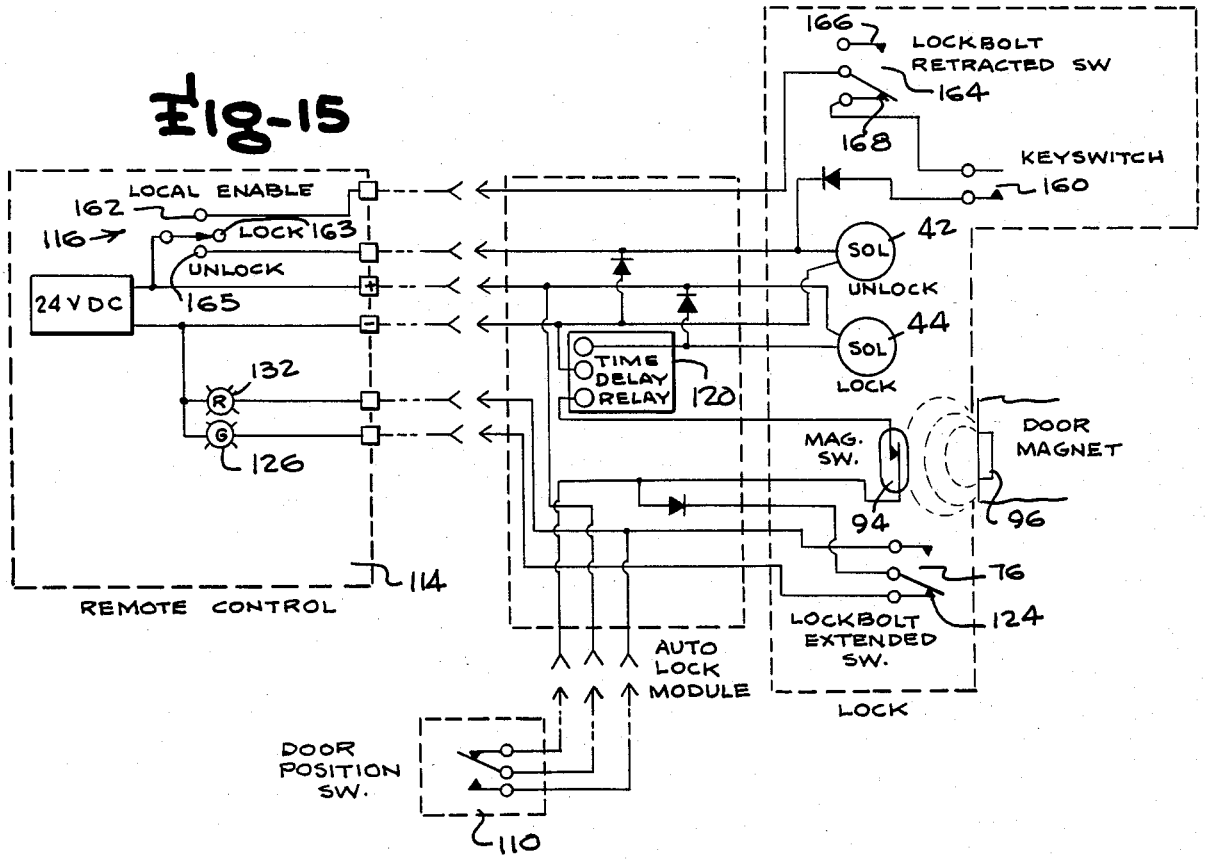
FIG. 15 is a circuit diagram of the control system including additional permissive inmate unlocking capability at the door site.

FIG. 15 illustrates a further modification of the control circuitry for permitting the inmate to lock and unlock the bolt under the permissive control of the guard from the remote control station 114. This system includes a key switch 160 which would normally be actuated by a lock cylinder positioned on the inside of the door jamb (in the inmate's room) and for which the inmate would have his own key which would permit the inmate to have his room locked during his absence to prevent other inmates from entering the room; however, the inmate would also be able to unlock the room upon his return. In this embodiment, the main control switch 116 is provided with a local enable contact 162 which is connected to the key switch 160 in series through a lock bolt retracted switch 164 which is in the illustrated condition when the door is closed and locked. The lock bolt retracted switch 164 is positioned on the base plate 20 as shown in FIG. 13 so as to be engaged by the switch actuator pin 74 when the bolt cam slide 40 is moved to its lower position.

Figure 12:
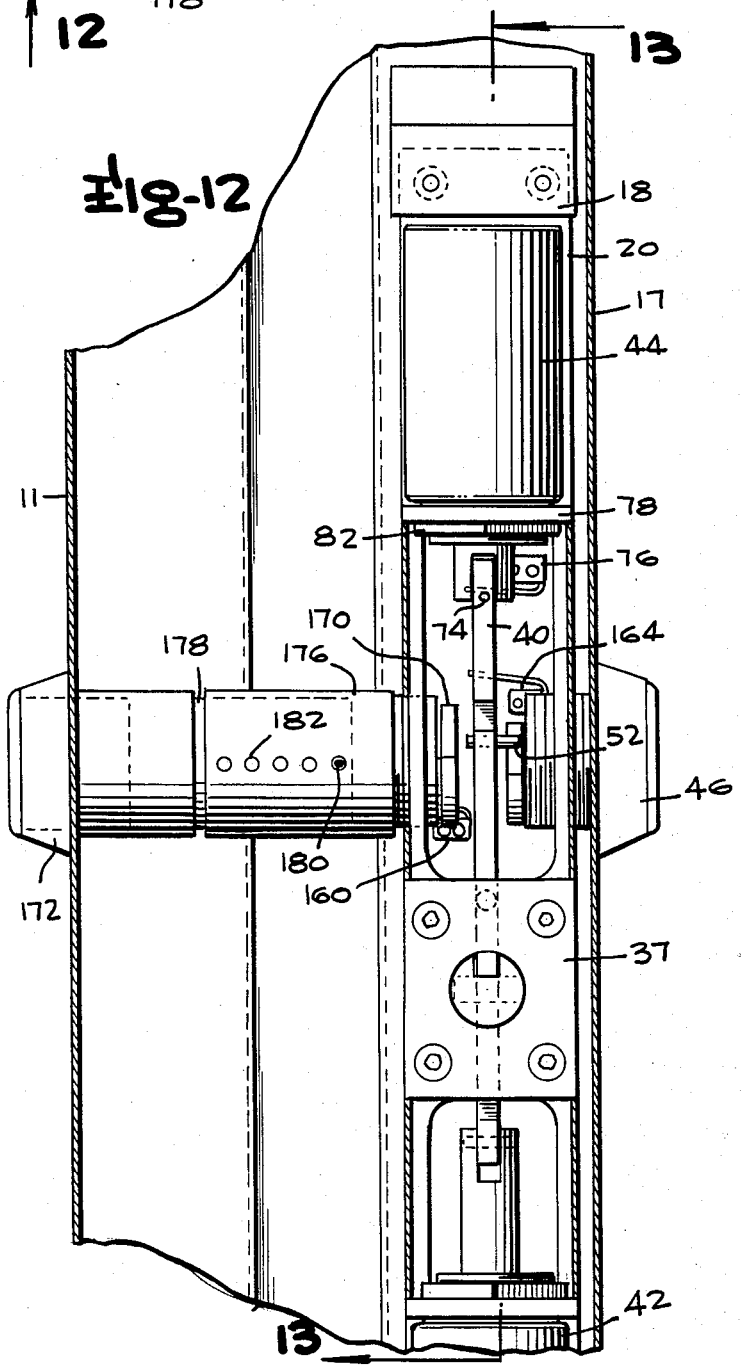
FIG. 12 is a sectional view taken along lines 12—12 of FIG. 11.

Key switch 160 is actuated by a cam arm 170 which is rotated by a lock cylinder 172 (FIG. 12) mounted in the inside face 11 of the steel door jamb 12 in the inmate's room for permitting the inmate to unlock the door. Cam arm 170 is driven by a drive shaft 174 extending from the lock cylinder 172 through an extension tube arrangement consisting of an external tube 176 in which a reduced diameter tube 178 is telescopically positioned and held by set screws 180. The reduced diameter tube 178 is a unitary extension of a slightly larger diameter tube 182 surrounding and extending from the lock cylinder 172. Lock cylinder 172 is a "hotel" type cylinder which can turn from a neutral position only in a clockwise direction as viewed in FIG. 13 so as to permit the cam arm 170 to actuate switch 160 following which the cam arm 170 can then return to the neutral position illustrated in FIG. 13. The telescopic arrangement between the external tube 176 and the reduced diameter internal tube 178 permits the unit to be adjusted to a desired length so as to be usable with a variety of different sizes of door jambs in which the distances between the faces 11 and 17 of the jambs will differ. It should be observed that a plurality of threaded apertures 182 are provided so as to permit a secure locking of the internal tube 178 in the external tube 176 by the use of set screw members 180. It would also be possible for switch 160 to be a simple push-button switch mounted in the inmate's room so as to eliminate lock cylinder 172 and means 176, 178, etc.

Figure 16:
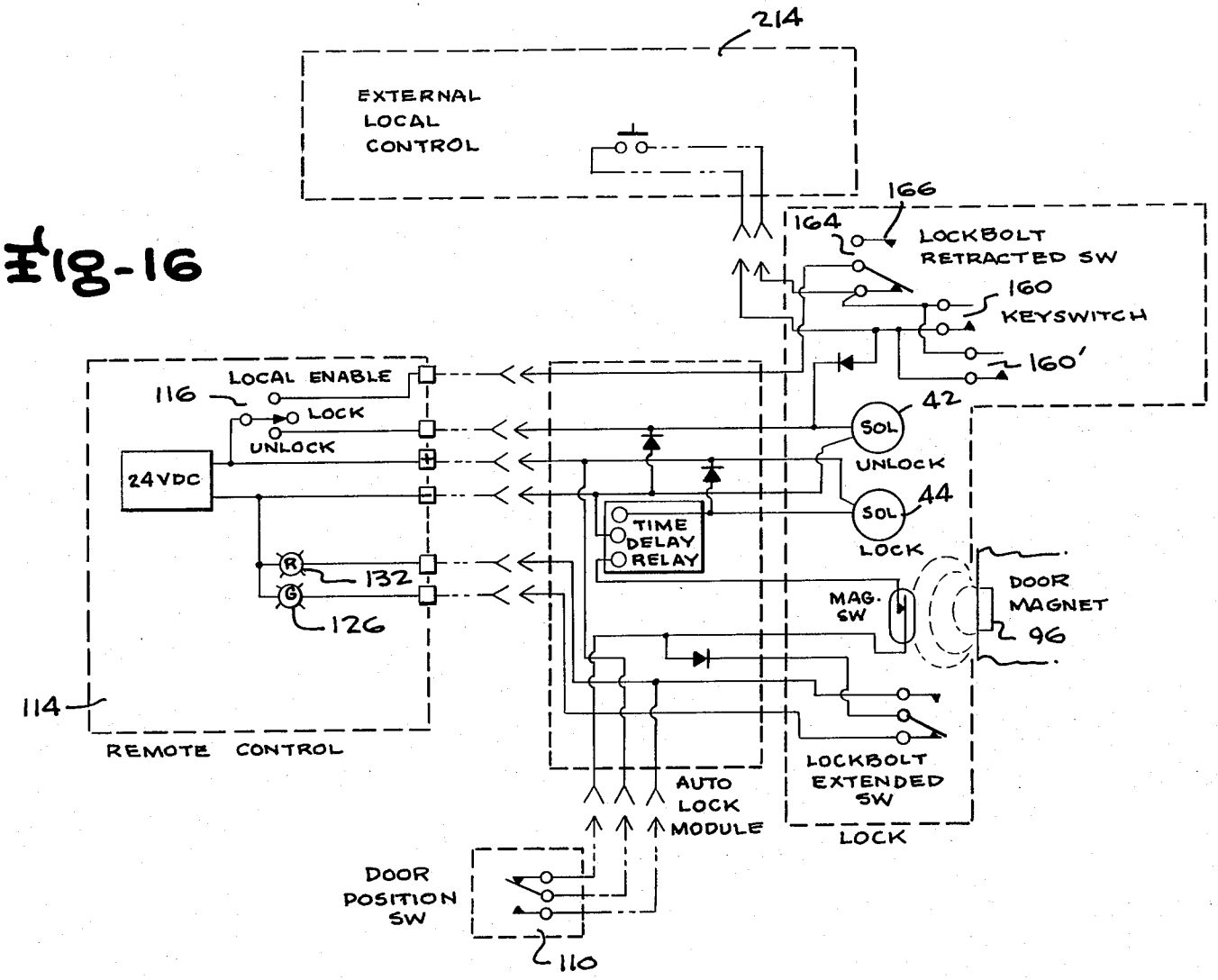
FIG. 16 is a circuit diagram including further permissive inmate unlocking functions from both sides of the door and a secondary external unlock control.

It should be understood that it is also possible to use a key switch mounted on the external face 17 of the jamb either in place of the mechanical cylinder lock 46 or in conjunction with the mechanical cylinder lock 46. FIG. 15 illustrates a control circuit for use with a single key switch embodiment such as that illustrated in FIGS. 12 and 13. However, it should be understood that the same circuit would be usable with a key switch provided in the external face 17 of the door jamb (in other words, in the hall or corridor) with the switch element 160 being moved to the opposite side of the assembly so as to be engageable with the cam arm rotated by the cylinder mounted in the face 17. It should be observed that the switch positions illustrated in FIG. 15, as well as the switch positions illustrated in FIGS. 14 and 16, are the positions assumed when the door is closed and locked. Thus, closure of key switch 160 effects actuation of solenoid 42 by virtue of the fact that the lock bolt retracted switch 164 is in the position illustrated in series with key switch 160 so as to permit actuation of solenoid 42. The solenoid is automatically deactivated upon movement of the switch element of lock bolt retracted switch 164 into contact with contact 166 so as to terminate the circuit through contact 168. When the switching element of main switch 16 is in contact with the local enable contact 162, the inmate can use his key switch for unlocking the door. However, when the main switch is in the position illustrated in FIG. 16 in which it is engaged with the lock contact 163, it is impossible for the key switch to complete the circuit necessary to actuate the unlock solenoid 42. Also, it should be observed that movement of the contact of the main switch member 116 into contact with the unlock contact 165 will actuate the unlock solenoid 42 to unlock the door. Switch 76 as employed in the circuit of FIG. 15 serves to cause illumination of either the red or green indicator lights in the manner of the embodiment of FIG. 14.

Along the same lines, FIG. 16 illustrates a control circuit in which a second key switch 160' has been provided inside the room to enable key switch operation from both inside the room and in the corridor. In other words, one of the switches would be mounted in the outside face 17 while the other would be mounted in the inside face 11 of the door jamb. The inside switch 160' could be either a push-button switch or a key switch. Both switches would still be controlled by the main control switch 116 in the same manner as the embodiment of FIG. 15. Additionally, FIG. 16 also illustrates the possibility of providing a second external local control station 214 which would be capable of controlling one or more doors in a small area such as a single hall or corridor. However, it should be observed that the external local control station 214 which is shown using a simple push-button switch remains under the overall control of the main remote control station 114 which would control a larger area such as a building or wing of a building. Otherwise, the operation of the control circuitry of FIG. 16 is identical to that of FIG. 15.

A significant aspect of all embodiments of the control circuitry is the fact that the lock solenoid 44 cannot be actuated unless the door 14 is in a closed position as evidenced by the condition of magnetic switch 94 and the door position switch 110. Damage to the bolt 30 by the slamming of doors against the extended bolt is consequently precluded.

It should be understood that only preferred embodiments of the invention have been disclosed and that obvious modifications of such not departing from the spirit and scope of the present invention will undoubtedly occur to those of skill in the art. Therefore, the scope of the present invention is to be limited solely by the appended claims.

I claim:

1. An electrically operated door locking system comprising:

a door mounted in a door jamb separating a room from a corridor or the like;

a modular carrier frame mounted in said door jamb;

bolt means mounted on said carrier frame for reciprocation between a retracted position wholly enclosed within said housing an an extended position in which one end of said bolt means protrudes from said housing;

a bolt actuator cam slide operable for movement between a lock position and an unlock position for respectively positioning said bolt means in said extended position or said retracted position;

guide surfaces on said carrier frame for precluding horizontal movement of the bolt actuator cam slide;

solenoid means for selectively positioning said bolt actuator slide in its unlock or lock positions;

a control circuit for said solenoid means including circuit means for actuating said solenoid means to cause the bolt actuator slide to move to its lock position in response to movement of the door to closed position; and means operable in response to said door not being in a fully closed position for preventing actuation of said solenoid means so as to preclude movement of the bolt to its lock position.

2. The system of claim 1, wherein:

said bolt includes a vertically extending slot through which said bolt actuator cam slide extends; and said solenoid means comprises a lock solenoid mounted on said carrier frame and connected to one end of said bolt actuator cam slide which lock solenoid when actuated moves said bolt to its lock position and an unlock solenoid mounted on said carrier frame connected to an opposite end of said bolt actuator cam slide which unlock solenoid when actuated moves said bolt to is unlock position.

3. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge; and said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position.

4. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to its unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position; and said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions.

5. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further including a remote control station having a main control switch, means for actuating the lock solenoid in response to positioning of the main control switch in a lock position and means for actuating the unlock solenoid in response to positioning of the main control switch in an unlock position; and further including mechanical lock cylinder means mounted on the exterior of the door jamb for mechanically moving the bolt activated cam slide between its lock position and its unlock position.

6. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further includes a remote control station having a main control switch, means for actuating the lock solenoid in response to positioning of the main control switch in a lock position and means for actuating the unlock solenoid in response to positioning of the main control switch in an unlock position and time delay means for deactivating said lock solenoid at a predetermined time interval following actuation of said lock solenoid; and further including mechanical lock cylinder means mounted on the exterior of the door jamb for mechanically moving the bolt activated cam slide between its lock position and its unlock position.

7. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generaly parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further includes a remote control station having a main control switch, means for actuating the lock solenoid in response to positioning of the main control switch in a lock position and means for actuating the unlock solenoid in response to positioning of the main control switch in an unlock position, time delay means for deactivating said lock solenoid at a predetermined time interval following actuation of said solenoid and means selectively operable for permitting permissive actuation of said unlock solenoid at a location adjacent the door in response to positioning of the main control switch in a local enable position; and further including mechanical lock cylinder means mounted on the exterior of the door jamb for mechanically moving the bolt activated cam slide between its lock position and its unlock position.

8. The system of claim 7 wherein said selectively operable means includes first key switch means positioned adjacent the door site on the corridor side of the door jamb.

9. The system of claim 8 wherein said selectively operable means includes second key switch means operable from a lock cylinder positioned adjacent the door site on the room side of the door jamb.

10. The system of claim 1, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to its unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further including a remote control station having a main control switch, means for actuating the lock solenoid in response to positioning of the main control switch in a lock position and means for actuating the unlock solenoid in response to positioning of the main control switch in an unlock position; and further including a mechanical release means including an actuator lever in said remote control station, cable means extending from said actuator lever to a pivot lever mounted in said jamb having a free end drivingly engageable with said unlock solenoid for moving said bolt cam slide to its unlock position in response to pivotal movement of said actuator lever.

11. The system of claim 10 wherein said time delay means for deactivating said lock solenoid at a predetermined time interval following actuation of said lock solenoid; and further including mechanical lock cylinder means mounted on the exterior of the door jamb for mechanically moving the bolt activated cam slide between its lock position and its unlock position.

12. An electrically operated door locking system comprising;

a door mounted in a door jamb separating a room from a corridor or the like;

a modular carrier frame mounted in said door jamb;

bolt means mounted on said carrier frame for reciprocation between a retracted unlock position wholly enclosed within said housing an an extended locking position in which one end of said bolt means protrudes from said housing;

a bolt actuator cam slide operable for movement between a lock position and an unlock position for respectively positioning said bolt means in said extended position or said retracted position;

solenoid means operable in unlock and lock modes of operation for selectively respectively positioning said bolt actuator slide in its unlock or lock positions;

a control circuit for said solenoid means including first and second series connected switch members operable in response to closure of the door for actuating said solenoid means to cause the bolt actuator slide to move to its lock position in response to movement of the door to the closed position; and means for automatically terminating power to said solenoid after a predetermined time period after actuation of the solenoid in the lock mode if the bolt is not in its extended locking position.

13. The system of claim 12, wherein:

said bolt includes a vertically extending slot through which said bolt actuator cam slide extends; and said solenoid means comprises a lock solenoid mounted on said carrier frame and connected to one end of said bolt actuator cam slide which lock solenoid when actuated moves said bolt to its lock position and an unlock solenoid mounted on said carrier frame connected to an opposite end of said bolt actuator cam slide which unlock solenoid when actuated moves said bolt to is unlock position.

14. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge; and said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extend of said slot and being engageable with said bolt extend camming surface following actuation of said lock solenid so that said bolt is resultantly moved to its lock position.

15. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a slot retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position; and said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions.

16. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further including a remote control station having a main control switch, means for actuating the lock solenoid in response to positioning of the main control switch in a lock position and means for actuating the unlock solenoid in response to positioning of the main control switch in an unlock position; and further including mechanical lock cylinder means mounted on the exterior of the door jamb for mechanically moving the bolt activated cam slide between its lock position and its unlock position.

17. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further includes a remote control station having a main control switch, means for actuating the lock solenoid in response to positioning of the main control switch in a lock position and means for actuating the unlock solenoid in response to positioning of the main control switch in an unlock position and time delay means for deactivating said lock solenoid at a predetermined time interval following actuation of said lock solenoid; and further including mechanical lock cylinder means mounted on the exterior of the door jamb for mechanically moving the bolt activated cam slide between its lock position and its unlock position.

18. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further includes a remote control station having a main control switch, means for actuating the lock solenoid in response to positioning of the main control switch in a lock position and means for actuating the unlock solenoid in response to positioning of the main control switch in an unlock position, time delay means for deactivating said lock solenoid at a predetermined time interval following actuation of said lock solenoid and means selectively operable for permitting permissive actuation of said unlock solenoid at a location adjacent the door in response to positioning of the main control switch in a local enable position; and further including mechanical lock cylinder means mounted on the exterior of the door jamb for mechanically moving the bolt activated cam slide between its lock position and its unlock position.

19. The system of claim 18 wherein said selectively operable means includes first key switch means positioned adjacent the door site on the corridor side of the door jamb.

20. The system of claim 19 wherein said selectively operable means includes second key switch means positioned adjacent the door site on the room side of the door jamb.

21. The system of claim 12, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further including a remote control station having a main control switch, means for actuating the lock solenoid in response to positioning of the main control switch in a lock position and means for actuating the unlock solenoid in response to positioning of the main control switch in an unlock position; and further including a mechanical release means including an actuator lever in said remote control station, cable means extending from said actuator lever to a pivot lever mounted in said jamb having a free end drivingly engageable with said unlock solenoid for moving said bolt cam slide to its unlock position in response to pivotal movement of said actuator lever.

22. The system of claim 21 wherein said time delay means for deactivating said lock solenoid at a predetermined time interval following actuation of said lock solenoid; and further including mechanical lock cylinder means mounted on the exterior of the door jamb for mechanically moving the bolt activated cam slide between its lock position and its unlock position.

23. The system of claim 12 additionally including:

a lock cylinder mounted in the door jamb on the room side thereof;

a first tubular member extending from said lock cylinder transversely of the door jamb;

a second tubular member telescopically associated with the first tubular member so as to be axially adjustable relative thereto and having an outer end positioned adjacent said carrier frame;

means for fixedly holding said tubular members in adjusted position relative to each other;

a rotatable drive shaft extending from said lock cylinder through said tubular members and terminating outwardly of the outer end of said second tubular member;

a cam arm mounted on the outer end of said drive shaft; and wherein said control circuit includes switch means positioned to be engaged by said cam arm when said cam arm is rotated by said drive shaft for completing a circuit to said solenoid means to cause the bolt actuator slide to move to its unlock position.

24. The system of claim 23, wherein:

said bolt includes a vertically extending slot through which said bolt actuator cam slide extends; and said solenoid means comprises a lock solenoid mounted on said carrier frame and connected to one end of said bolt actuator cam slide which lock solenoid when actuated moves said bolt to its lock position and an unlock solenoid mounted on said carrier frame connected to an opposite end of said bolt actuator cam slide which unlock solenoid when actuated moves said bolt to is unlock position.

25. The system of claim 23, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge; and said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position.

26. The system of claim 23, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position; and said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions.

27. The system of claim 23, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further including a remote control station having a main control switch, means for actuating the lock solenoid in response to positioning of the main control switch in a lock position and means for actuating the unlock solenoid in response to positioning of the main control switch in an unlock position; and further including mechanical lock cylinder means mounted on the exterior of the door jamb for mechanically moving the bolt activated cam slide between its lock position and its unlock position.

28. The system of claim 23, wherein:

said bolt includes a vertically extending slot through which said bolt actuator cam slide extends for vertical movement;

said solenoid means comprises a lock solenoid connected to one end of said bolt actuator cam slide which lock solenoid when actuated moves said bolt to its lock position and an unlock solenoid connected to an opposite end of said bolt actuator cam slide which unlock solenoid when actuated moves said bolt to is unlock position;

said bolt actuator cam slide has front and rear edges and includes a bolt extend camming surface on said forward edge and a bolt retract camming surface along its rear edge and an internal slot in said slide comprising a central slot portion oriented at an acute angle relative to the direction of movement of the slide and upper and lower slot deadlock slot portions generally parallel to the direction of slide movement;

said slot in said bolt includes a bolt retract follower surface defining a portion of its rear extent and engageable with said bolt retract camming surface following actuation of said unlock solenoid so that said bolt is resultantly moved to its unlock position and a bolt extend follower surface defining a portion of the forward extent of said slot and being engageable with said bolt extend camming surface following actuation of said lock solenoid so that said bolt is resultantly moved to its lock position;

said bolt includes a lock pin extending across said slot in said bolt and passing through said internal slot in said slide with said lock pin being positioned in one or the other of said upper or lower deadlock slot portions when the slide is in its lock or unlock positions so as to deadlock the bolt in its retracted or extended positions; and said control circuit further includes a remote control station having a main control switch, means for actuating the lock solenoid in response to positioning of the main control switch in a lock position and means for actuating the unlock solenoid in response to positioning of the main control switch in an unlock position and time delay means for deactivating said lock solenoid at a predetermined time interval following actuation of said lock solenoid; and further including mechanical lock cylinder means mounted on the exterior of the door jamb for mechanically moving the bolt activated cam slide between its lock position and its unlock position.

29. The system of claim 28, wherein said control circuit includes selectively operable means for permitting actuation of said unlock solenoid by said switch means positioned to be engaged by said cam arm only when said main control switch is in a local enable position.

* * * * *